United States Patent [19]

Schmidt

[11] Patent Number: 5,042,554

[45] Date of Patent: Aug. 27, 1991

[54] SUPPORT OR GUIDE ROLLER DEVICE

[75] Inventor: Karl H. Schmidt, Wilnsdorf-Niederdielfen, Fed. Rep. of Germany

[73] Assignee: Siegenia-Frank KG, Siegen, Fed. Rep. of Germany

[21] Appl. No.: 396,594

[22] Filed: Aug. 21, 1989

[30] Foreign Application Priority Data

Aug. 24, 1988 [DE] Fed. Rep. of Germany ..... 3828708

[51] Int. Cl.[5] ..... E05D 15/26

[52] U.S. Cl. ..... 160/199; 160/206; 16/105

[58] Field of Search ..... 160/199, 206, 196.1; 16/97, 95, 105, 100

[56] References Cited

U.S. PATENT DOCUMENTS

| | | | |
|---|---|---|---|
| 871,386 | 11/1907 | Burkholder | 16/105 |
| 1,191,334 | 7/1916 | Myers | 16/105 |
| 1,377,135 | 5/1921 | Kules | 16/105 X |
| 3,793,673 | 2/1974 | Lawrence, Jr. | 16/97 |

FOREIGN PATENT DOCUMENTS

| | | |
|---|---|---|
| 6939860 | 1/1970 | Fed. Rep. of Germany . |
| 1810671 | 6/1970 | Fed. Rep. of Germany . |
| 2125626 | 12/1972 | Fed. Rep. of Germany . |
| 2150237 | 4/1973 | Fed. Rep. of Germany . |
| 8200884 | 9/1982 | Fed. Rep. of Germany . |
| 3602611 | 8/1987 | Fed. Rep. of Germany . |
| 750762 | 8/1933 | France . |
| 5922232 | 7/1977 | Switzerland . |

OTHER PUBLICATIONS

Gretsch-Unitas illustrated catalog 102a "Special Mountings for Folding Doors . . ." date unknown.

Hafele Brochure-"Hawa Fold Away" no publication date shown.

*Primary Examiner*—Blair M. Johnson

*Attorney, Agent, or Firm*—Blodgett & Blodgett

[57] ABSTRACT

A support and/or guide roller device for folding, sliding panels which consists of support pedestal (29) resting on the front side of panel (5) for one of the ends of the vertical axle bolt (23), whose other end is supported in a running carriage (21) for support rollers (22) or guide rollers. The distance between support pedestal (29) and running carriage (21) of support rollers (22) or the distance of the guide roller from this may be adjusted and fixed in the longitudinal direction of axial bolt (23). So that the support and/or guide roller device can be adapted to different thickness measurements of the panel cross-sections, axle bolt (23) sits on a bracket arm (26), with which support pedestal (29) can be displaced in a limiting manner essentially crosswise to the panel plane and can be set in a fixed manner in any chosen position (43-46 and 51.)

11 Claims, 7 Drawing Sheets

SUPPORT OR GUIDE ROLLER DEVICE

FIELD OF THE INVENTION

The invention concerns a support and/or guide roller device for sliding panels of windows, doors or the like arranged in a moveable manner around vertical axes in stationary runner and guide rails. It is particularly directed to folding/sliding panels and so-called "bellow-framed" sliding panels. The devices consist of support pedestals attached to the front side of the panel for one of the ends of the vertical axle bolt, whose other end is placed in the running carriage for the support roller or supports and guide rollers. The distance between the support pedestals and the running carriage of the support rollers or the guide roller is adjustable and can be fixed in the longitudinal direction of the axle bolt. The axle bolt rests on a bracket arm and the bracket arm, as part of a plate on the support pedestal, is limitedly displaceable essentially crosswise to the panel plane and can be held fast in any position.

Support and/or guide roller devices of this type are applied primarily in folding sliding windows and doors; they may, however, also be utilized in some cases in so-called "bellow-framed" sliding windows and doors.

BACKGROUND OF THE INVENTION

Support and/or guide roller devices of a similar type have been known in the prior art for a long time (see, for example, Gretsch-Unitas illustrated catalog 102*a* "Special Mountings for Folding Doors . . . ", pages 12 and 13). In these known support and/or guide roller devices, it is possible to adjust the height or level of each panel relative to the stationary frame, within certain limits, by a support and/or roller guide device in combination with a fixed panel, since the distance between the support pedestal and the running carriage of the support rollers supported on the stationary runner rail can be changed as needed.

An adaptation to variable distances of the panel front surface serving for attachment of the support pedestal to the front surface of the frame forming the attachment or alignment base for the stationary runner and guide rails has, however, not previously been possible.

When the known support and/or guide roller devices for windows and doors are utilized with panel cross-sections of various thicknesses, it is thus assumed that either runner and guide rails adapted to this are prepared with different profiles or, alternatively, that the runner and guide rails on the stationary frame and/or the support pedestals on the panel are adpated to the cross-sections of varying thickness by the use of special support plates.

In support and/or guide roller devices of this type according to German GM 6,939,860, the axle bolt rests on a bracket arm joined to a support pedestal mounted on the front side of the panel. The latter is thus limitedly displaceable on the support pedestal essentially crosswise to the panel plane and can be held fast in any position. Therefore, the bracket is shaped of flat stock according to a kind of U-shaped bow, which rests with the ends of the bow piece on a hinge bolt held by the support pedestal and must be locked in the region of the bow center-piece by a special support bracket in the adjusted tilted position each time.

This known support and/or guide roller device is not only expensive with respect to material and has a large space requirement, but also has the disadvantage that different support brackets must be used, as the case may be, for different tilted positions, if the desirable or necessary stability is to be assured.

German OS (Unexamined Patent Disclosure) 3,602,611 also has as its subject a mounting for folding sliding doors, which has support and/or guide roller divices for folding sliding panels. However, here a lever is arranged on each of the two adjacent panels by means of clamping devices and both levers are joined together to form a hinge by means of the bolts engaging the running carriage or supporting the guide roller.

The two levers or the hinge formed by them can be adjusted relative to the adjacent panels only in a direction parallel to the panel plane by means of clamping devices. This is done for the purpose of varying the lateral distance between the upright (vertical) edges of the adjacent panel corresponding to the purpose intended.

However, an adjustment of the hinges in the direction crosswise to the panel plane is only possible by providing slide bushings placed in both ends of the lever with eccentric boreholes and arranged in a rotatable manner.

CH Patent Disclosure 592,232 discloses a support and/or guide roller device, in which the running carriage bearing the support and/or guide rollers in the same way as in German OS (Unexamined Patent Disclosure) 3,602,611, at the same time holds a hinge by means of a vertical axle bolt, which hinge is arranged on two folding sliding panels adjacent to each other.

An ajustment means for adjusting the position of the hinge and/or the axle bolt relative to the adjacent folding sliding panels, however, is not present here. This and other difficulties experienced with the prior art have been obviated in a novel and unobvious manner by the present invention.

It is therefore an outstanding object of the invention to provide support and/or guide roller device of the type indicated above, which offers the possibility of adapting to different panel projection thicknesses, while retaining the adjustment capacity of the panel in the height direction and thus makes it necessary to utilize only one profile dimension for the stationary runner and guide rails for all installation cases encountered.

With this and other objects in view, as will be apparent to those skilled in the art, the invention resides in the combination of parts set forth in the specification and covered by the claims appended hereto.

SUMMARY OF THE INVENTION

These objects are achieved according to the invention by holding the bracket arm with its plate in a pocket formed on the support pedestal between two essentially horizontal supporting walls and providing the pocket with a profile section from the front surface of the folding sliding panel out over the surface of the support pedestal parallel thereto.

The bracket arm formed by a flat plate in the pocket of the support pedestal may be of large surface and thus be supported securely crosswise to its tilting plane. Thus it is reliably supported within the pocket in any possible tilted plane without the necessity of fixing the tilted position by means of an additional support bracket.

In the support and/or guide roller device according to the invention, a bracket arm is arranged in each case on only one of the neighboring folding sliding panels and this bracket arm is able to be swiveled to a limited degree essentially crosswise to the plane of the panel supporting it and can be fixed in any such swiveled position.

The hinge-type joint with the neighboring panel is provided separately, on the other hand, and thus does not involve the intervention of the bracket arm.

The bracket arm may be brought in this way to varying angular positions relative to the panel plane, so that the axial distance of the axle bolt can be varied crosswise to the panel plane and thus can be adapted to different cross-sectional thickneses of the panel. (It is known to produce the effective joint between panel-side support brackets and running carriages with support rollers or bearing axes with guide rollers by means of intermediately-connected bracket arms—see the prospectus "Folding Sliding Door Mounting (Hawa foldaway)". However, in that case, the bracket arms are rigidly joined with the support brackets and the latter are not attached onto the front side of the panel, but are placed against the peripheral surfaces of the panel. An adaptation to different individual ratios is thus not possible with this solution. In addition, the carrying capacity of this support and/or guide roller device known from the prior art is relatively small.)

A particularly stable arrangement is obtained if, according to another aspect of the invention, the engagement depth of the plate in the pocket corresponds to a multiple (e.g. approximately quadruple) the distance between the axle bolt and the pocket opening, so that the bracket arm has a large support length and surface.

It has also proven to be an effective solution according to another aspect of the invention if the plate is angularly displaceable at its back end where it is located between two essentially vertical support walls of the pocket. These vertical support walls on the open end of the pocket have a distance between them that is measured by the maximum adjustable path in excess of the width of the plate. In this way, it is possible by simple means to bring the bracket arm formed as a plate into a plug-in connection, whereby the plate can be fixed in the pocket by clamping elements according to another aspect of the invention.

In a particularly advantageous structural form of the support and/or guide roller device of the invention, the clamping elements may be formed by a cap screw passing through a hole in the plate and bow slots in the horizontal support walls of the pocket and a nut engaging with the latter. The screw can thus engage by its head the retaining surfaces formed between stationary pieces of the pocket to prevent rotation.

Unlike the support and/or guide roller devices of the prior art, the means for adjusting the height of the panel relative to the stationary frame are not provided between the axle bolt and the support pedestals attached to the front side of the panel. Instead, the axle bolt consists rather of a headless screw joined with the bracket or the plate in a rotation-fast manner and a threaded sleeve holding the rolling carriage of the support rollers or the guide rolles, whereby the threaded sleeve can be axially adjusted and held fast on the headless screw by a lock nut.

The adjustment means proper for the height adjustment of the panel thus are relatively closely placed next to the stationary runner or guide rail and can be operated there simply and without difficulty by means of suitable adjusting tools.

It is of advantage for a high stability of the joint between the support pedestal and the panel if the support pedestal has an angled shape and if the pocket is formed in one piece on the outer limiting edge of the horizontal portion of the angle. In this case, there is the possibility that the region of the support pedestal containing the pocket may project backward and in this way form an alignment and support assembly for the peripheral surface of the panel. The portion of the pocket that operates together with the peripheral surface of the panel may have a dimension which is adapted to the minimal thickness that is encountered for the panel cross-section.

In a support and/or guide roller device, which is used in windows and doors with sliding-folding panels in a place where two neighboring panels are combined with each other by hinges, it has proven particularly advantageous for simplifying the construction of the total mounting, if a hinge sleeve with a vertical axis is rigidly joined with the outer limiting edge of the upright angled portion of the support pedestal, with which the hinge sleeves of a hinge plate for the neighboring panel can be coupled by means of a socket pin.

The hinge joint between the panel held or supported directly by the support and/or guide roller device and the neighboring panel linked to this may be removed in this case simply by pulling the socket pin and is attached again by utilizing the latter without any manipulations being necessary with respect to the vertical axle bolt, as would be the case in the support and/or guide roller devices of the prior art.

Finally, according to the invention it has also proven advantageous if the hinge plate on the neighboring panel can be held in an adjustable manner crosswise to the hinge axis, but parallel to the panel plane by means of positioning means such as threaded components, cams, or the like, so that the lateral distance between the neighboring panel which are joined together can be varied according to the specific application.

In cnventional hinge frames (including those which are applied in combination with sliding-folding panels of windows and doors), it is already known how to provide positioning means for adjustment purposes, which allow a positional adjustment of the panel in the horizontal direction. The present invention provides that these adjustment means belong to a hinge joint, which is combined in a functionally uniform manner with a support and/or guide roller device, which unites three different adjustment directions (vertical and horizontal parallel to the panel plane as well as horizontal crosswise to the frame plane).

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
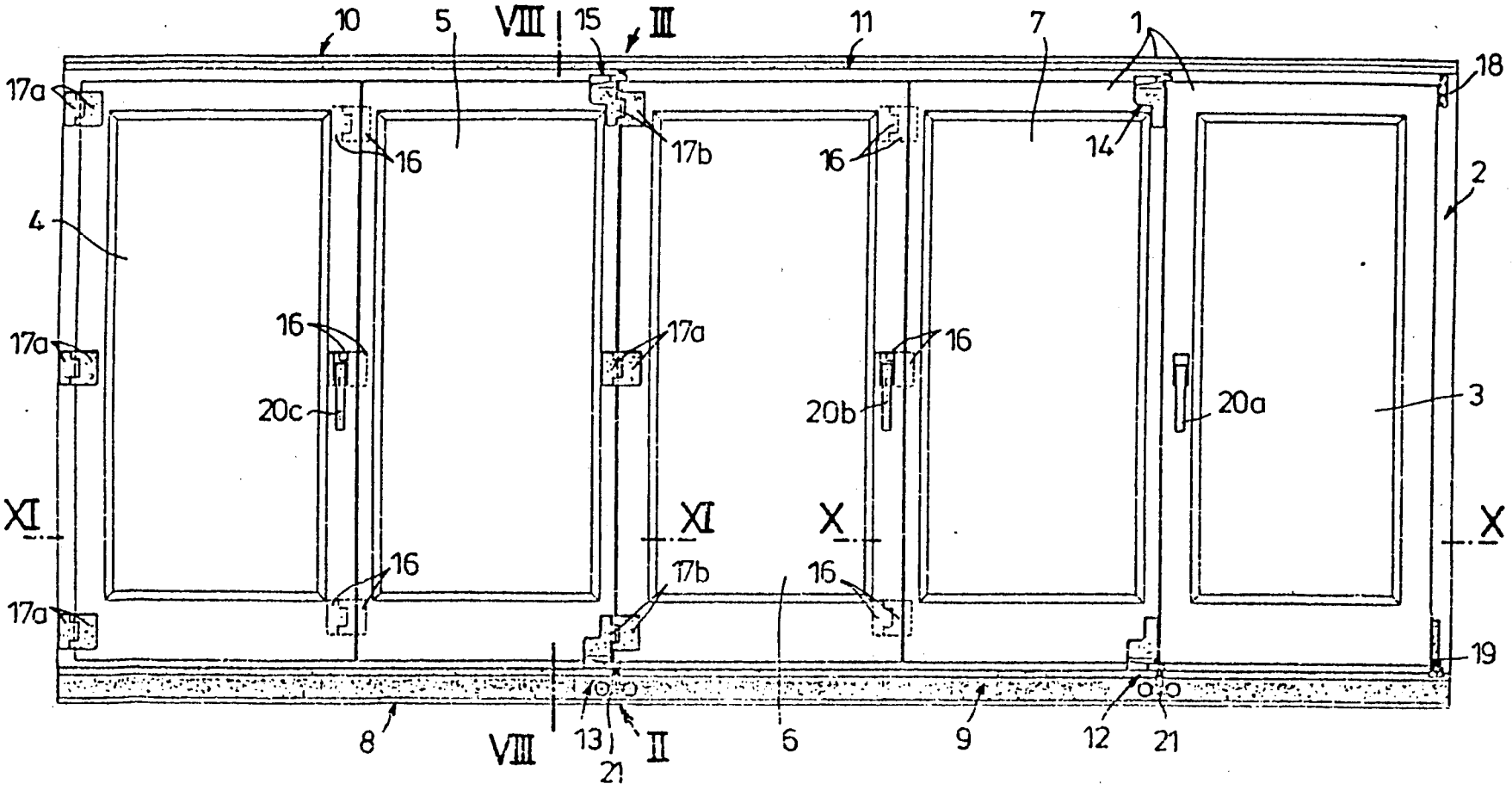
FIG. 1 shows in schematically simplified representation a folding/sliding door with four joined folding/sliding panels, which can be moved horizontally by means of two support roller devices and two guide roller devices in the stationary runner and guide rails of the stationary frame and cooperate with a turning balance panel.

In FIG. 1 of the drawing, as a practical example of the invention, a door element 1 is shown, which comprises a stationary frame 2 and five panels 3, 4, 5, 6 and 7 coordinated with FRAME 3. The panel 3 coordinated on the right to stationary frame 2 thus acts as a turning balance panel, whereas panel 4 incorporated on the left in stationary frame 2 is suspended simply as a turning panel. The other three panels 5, 6 and 7 are each joined together in a moveable manner around vertical hinge axes, wherein panel 5 also has a hinge joint with the vertical axis of turning panel 4 and panel 7 lies adjacent to turning balance panel 3. Panels 5, 6 and 7 are each effective as so-called folding/sliding panels and together with turning panel 4 form a functional unit which can move relative to stationary frame 2.

According to FIG. 1, a runner rail 9 is joined in a stationary manner with the lower horizontal capping piece 8 of the stationary frame, whereas the upper horizontal capping piece 10 of stationary frame 2 bears a guide rail 11 lying parallel to runner rail 9. Runner rails 9 are coordinated with two support roller devices 12 and 13, whereas two guide roller devices 14 and 15 work together with guide rail 11. Support roller device 12 is joined with the lower right corner of folding sliding panel 7, while the upper right corner of this folding sliding panel 7 supports guide roller device 14.

Support roller device 13 is introduced on the lower right edge of folding sliding panel 5, whereas guide roller device 15 is joined with the upper right corner of this folding sliding panel 5. Outer hinges 16 on the one hand join the two folding sliding panels 7 and 6 with each other and on the other hand make the joint between folding sliding panel 5 and turning panel 4.

Inner hinges 17*a* and 17*b* again join the two folding sliding panels 6 and 5 with each other, while other inner hinges 17*a* are provided in order to form the joint between turning panel 4 and stationary frame 2.

On one side, shear bearing 18 and on the other side corner bearing 19 are joined to the stationary frame for the mounting of turning balance panel 3. Hand lever 20*a* is used to operate turning balance panel 3, whereas corresponding hand levers 20*b* and 20*c* are found on folding sliding panel 6 and on turning panel 4. Bolt locks are activated in each case by means of hand levers 20*b* and 20*c*, by means of which the closed position of panels 7 and 6 as well as 5 and 4 may be fixed relative to each other and relative to stationary frame 2.

Outer hinges 16 and inner hinges 17*a* have corresponding structures and thus may be exchanged with one another. Inner hinges 17*b* are different from outer hinges 16 and inner hinges 17*a* by the fact that they are combined in a functionally uniform manner with support roller device 13 or guide roller device 15.

The structure and mode of operation of support roller devices 12 and 13 are explained in detail in the following based on FIGS. 2, 4, 5 as well as 8 and 9, whereas the structures and mode of operation of the guide roller devices 14 and 15 will be described in detail on the basis of FIGS. 3 and 6-9.

Support roller device 13 is distinguished from support roller device 12 basically only by the fact that an inner hinge 17*b* is integrated into its structure, which is missing in support roller device 12, since the latter is coordinated with folding sliding panel 7 adjacent to turning balance panel 3.

Figure 2:
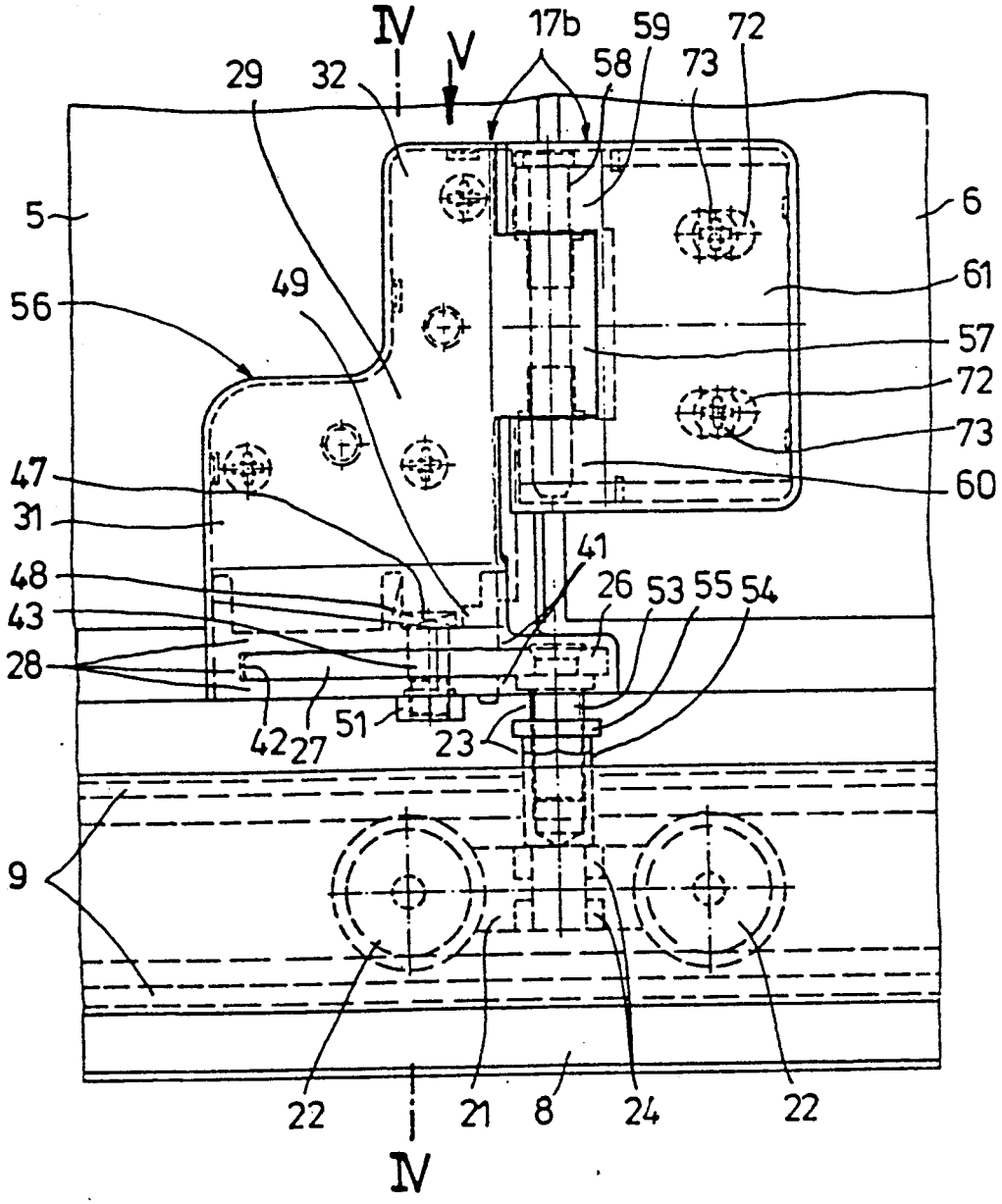
FIG. 2 shows, in larger-scaled representation the support roller device characterized by II in FIG. 1.
Figure 3:
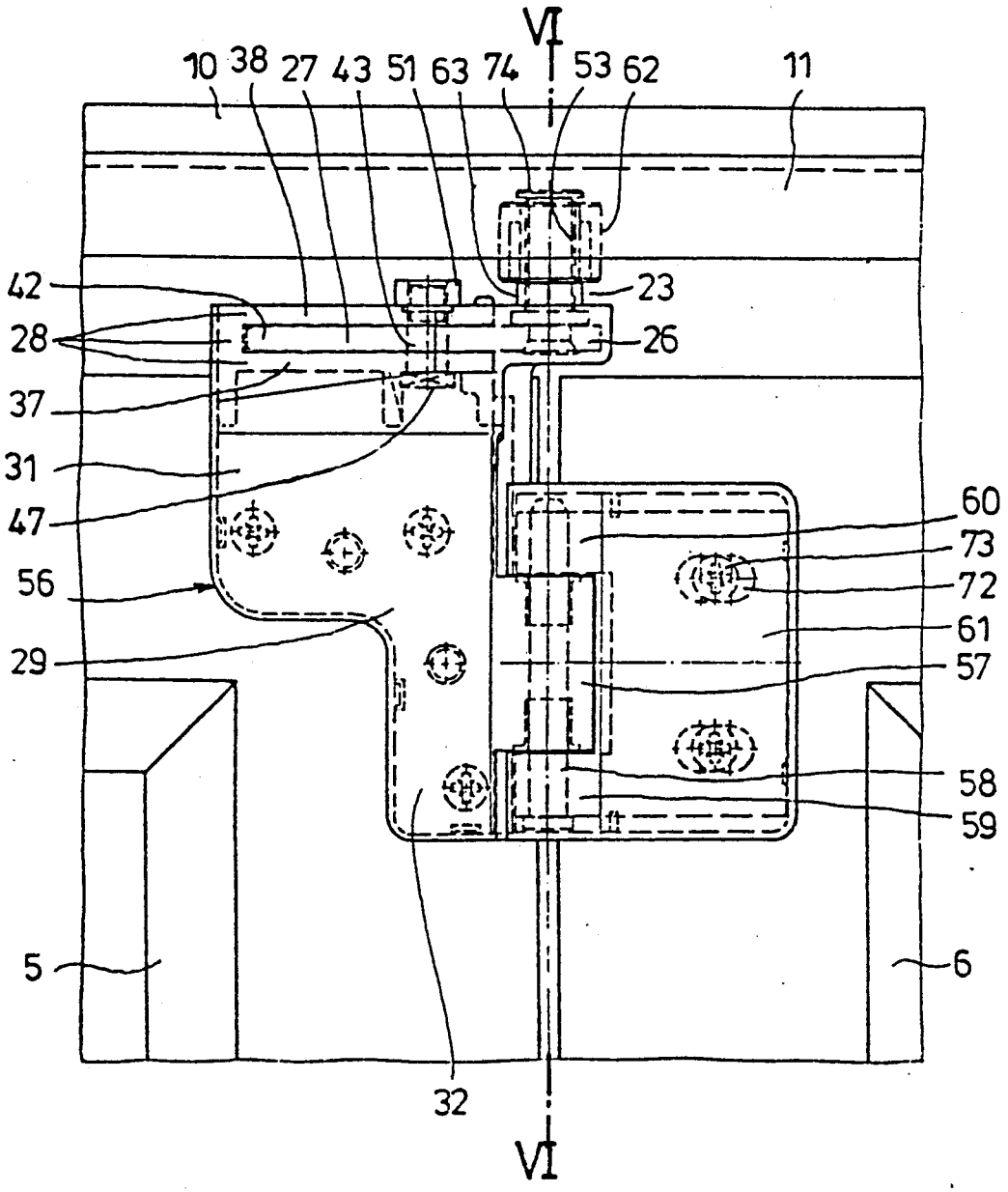
FIG. 3 shows, in larger-scaled representation the guide roller device characterized by III in FIG. 1.
Figure 4:
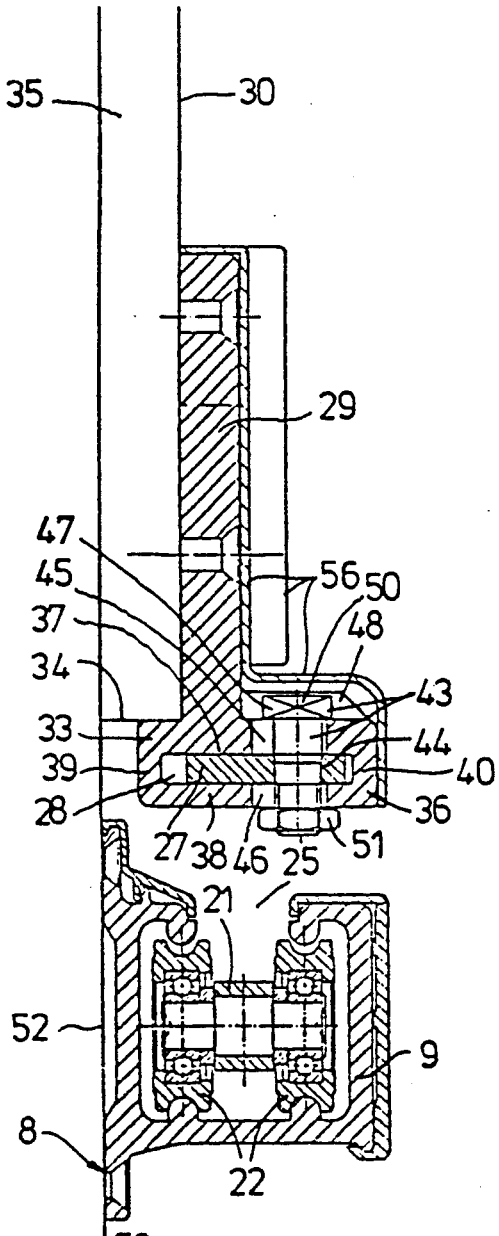
FIG. 4 shows a section along IV—IV in FIG. 2 through the support roller device.

Like support roller device 12, support roller device 13 also cooperates with stationary runner rail 9 by means of a running carriage 21, wherein running carriage 21 is provided with two pairs of support rollers 22 as can be seen in FIGS. 2 and 4. Runner carriage 21 and support roller pairs 22 are thus enclosed to a great extent by the profile of runner rail 9, as can be seen particularly clearly in FIGS. 4, 8 and 9 of the drawing. Only one of axle bolts 23 supported by running carriage 21, which bolt is held in a rotating manner in running carriage 21, for example, in roller bearings 24, projects from a longitudinal gap in the profile of runner rail 9.

Axle bolt 23, on the other hand—outside runner rail 9—is attached to a bracket arm 26 of a plate 27, which extends at least approximately parallel to runner rail 9 as well as perpendicular to axle bolt 23.

Bracket arm 26 engages laterally with plate 27 in a pocket 28, which is made up in one piece rigidly with a support pedestal 29, which rests on the front side 30 of folding sliding panel 5 or 7. Thus support pedestal 29 preferably has an angled shape, i.e., it is formed by a horizontal portion 31 and an upright portion 32 made up in one piece. Pocket 28 is thereby formed in one piece on the outer limiting edge of horizontal side portion 31 and has a profile section 33, with which it is supported at the peripheral surface 34 of panel cross-section 35, as can be clearly seen from FIGS. 4, 8 and 9. A profile section 36 on the other side of profile section 33 of pocket 28, on the other hand, projects out from front surface 30 of folding sliding panel 5 or 7 over the surface of support pedestal 29 and parallel to this surface, as is also seen from FIGS. 4, 8 and 9. FIG. 5 of the drawing also clearly illustrates the configuration of support pedestal 29 with the profile sections 33 and 36 forming pocket 28.

Figure 5:
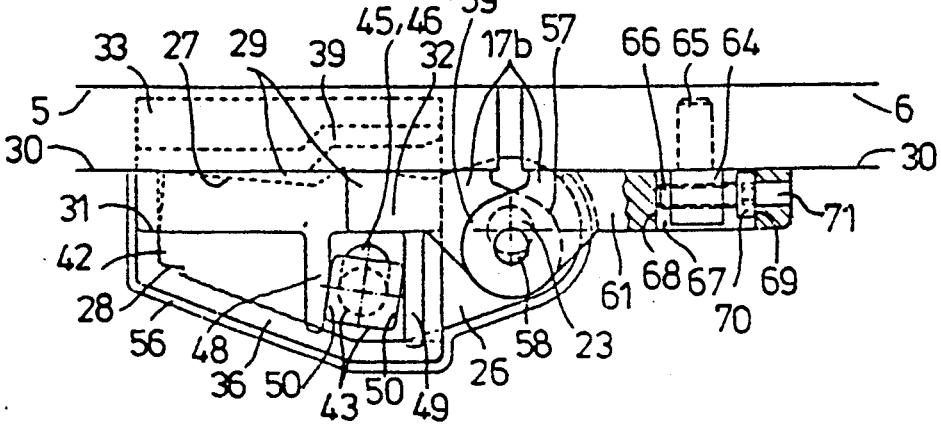
FIG. 5 shows a partially cutaway view in the direction of arrow V of FIG. 2 on the support roller device.

Pocket 28, which receives plate 27 of bracket arm 26, is bounded by two essentially horizontal supporting walls 37 and 38 as well as two essentially vertical supporting walls 39 and 40, which can be seen in FIGS. 4 and 5.

Thus, whereas the distance between horizontal supporting walls 37 and 38 is coordinated with the necessary play required for movement with respect to the thickness of plate 27 of bracket arm 26, the vertical supporting walls 39 and 40 are configured in such a way and provided at such a distance from each other that a displacement of plate 27 of bracket arm 26 is possible between them to a limited extent in the direction of their principal plane.

The depth of engagement of plate 27 in pocket 28 corresponds to a multiple, for example, approximately quadruple, the distance between the axle bolt 23 attached in bracket arm 26 and pocket opening 41. The back end 42 of plate 27 of bracket arm 26 is held in a limitedly angularly displaceable manner directly between the vertical supporting walls 39 and 40, which display there a corresponding distance from one another, without special means of attachment—according to a type of so-called "knife-edge support", so that the dimension of the angular displacement of the plate is determined by the width of pocket opening 41.

Plate 27 of bracket arm 26 is secured against longitudinal displacement in pocket 28 by a threaded fastener 43 with a head, which passes through a round hole 44 of plate 27 and is guided through bow slots 45 and 46 in horizontal supporting walls 37 and 38. Also, the extent of angular displacement of bracket arm 26 relative to support pedestal 29 is determined by the length of bow slots 45 and 46. Head 47 of thread fastener 43 lies on the outside of horizontal support wall 37 between two stationary pieces 48 and 49, the head having retaining surfaces 50 which work together with pieces 48 and 49 as a protection from displacement for threaded fastener 43. A nut 51 is screwed onto the shaft of threaded fastener 43 on the outside horizontal support wall 38, by means of which an axial bracing of screw 43 on horizontal support walls 37 and 38 of pocket 28 may be effected. Threaded fastener 43 and nut 51 thus form clamping elements, by means of which plate 27 can be securely held inside pocket 28 and thus bracket arm 26 is securely held in any possible adjustment position relative to support pedestal 29.

Axial bolt 23 may thus be adjusted without problem against support pedestal 29 in this way by means of bracket arm 26 and its plate 27, such that different thicknesses of the panel cross-section 35 and thus varying distances of the front side 30 of folding/sliding panel 5 or 7 from front side 52 of stationary frame 2 supporting runner rail 9 may be bridged with the utilization of only a single size and shape for runner rail 9.

The profile thickness of panel cross-section 35 can vary, for example, between a minimal extent of 15 mm and a maximal extent of 22 mm, so that it is meaningful to provide an adjustability of bracket arm 26 relative to support pedestal 29 in the direction crosswise to the longitudinal axis of axle bolt 23, which is at least 8 mm.

Axle bolt 23 is designed in two parts. It consists of a headless threaded fastener 53 joined in a rotation-proof manner with bracket arm 26 and a threaded sleeve 54, which on the one hand encompasses headless threaded fastener 53 in an adjustable, form-closed manner and on the other hand is held in an axially non-displaceable manner, but with free rotation in roller bearings 24 of rolling carriage 21. The effective length of axle bolt 23 may be varied by a relative rotation of threaded sleeve 54 to headless threaded fastener 53. In this way it is then possible to vary the height position of any folding sliding panel 5 or 7 relative to stationary frame 2 or runner rail 9 which is provided in a stationary manner thereon. The respective length adjustment of axle bolt 23 may be stabilized by providing headless threaded fastener 53 with a lock nut 55, which can be braced against the front surface of threaded sleeve 54.

It is advantageous in a support roller device such as 13 or 12 that an adjusting and fixing means both for bracket arm 26 as well as for axle bolt 23 provided thereon lie close together and are so configured that they may be operated with corresponding tools (e.g., monkey wrenches). Although these adjustment means are found above in the free space between peripheral surface 34 of the panel cross-section and the longitudinal limiting surfaces of runner rail 9 opposite it in front of front surface 54 of stationary frame 2, they are also accessible at any time, if support pedestal 29 resting on folding/sliding panel 5 or 7 and bracket arm 26 joined therewith are enclosed by a covering cap 56, for example, comprised of a laminated material such as plastic molding or deep-drawn sheet metal.

As has already been mentioned previously—in connection with FIG. 1—support roller device 13, as it is shown in FIG. 2, is distinguished from support roller device 12, be seen in FIG. 1, only by the fact that in the former the support pedestal 29 forms at the same time the functional part of an inner hinge **17*b* which is also attached to folding/sliding panel 5, by means of which the neighboring folding/sliding panel 6 can be joined in a detachable manner with folding/sliding panel 5**.

For this reason, a hinge sleeve 57 is shaped solidly in one piece on support pedestal 29 of support roller device 13, precisely on the outer limiting edge of its upright angle portion 32. The two hinge sleeves 59 and 60 of a plate-shaped hinge joint part 61, which is to be attached onto front side 30 of panel 6—in a similar way to support pedestal 29—can be coupled by means of a detachable socket pin 58.

Hinge sleeve 57 is provided on support pedestal 29 and hinge sleeves 59 and 60 are provided on hinge joint part 61, such that they have, at least approximately, a common axial plane with the longitudinal axis of axle bolt 23, which extends crosswise to the principal plane of stationary frame 2 (see FIG. 5). The arrangement of hinge sleeves 59 and 60 on hinge joint part 61 is made such that one of these hinge sleeves 59 or 60 is always placed above, while the other hinge sleeve 60 or 59 is placed below joint sleeve 57 of support pedestal 29. The weight of the folding sliding panel 6 to be supported is thus transferred in any case to folding/sliding panel 5 provided with support roller device 12 by means of inner hinge **17*b***.

Figure 7:
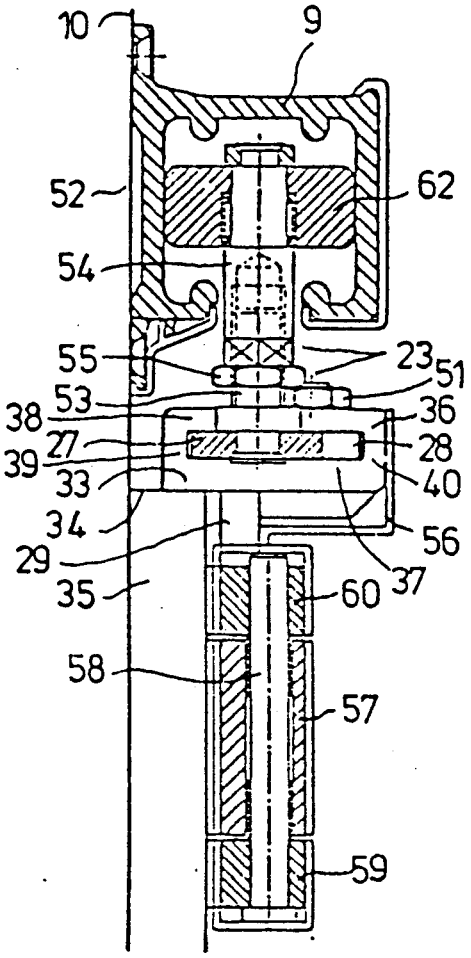
FIG. 7 shows a section corresponding to FIG. 6 with a modified design of the guide roller device.
Figure 6:
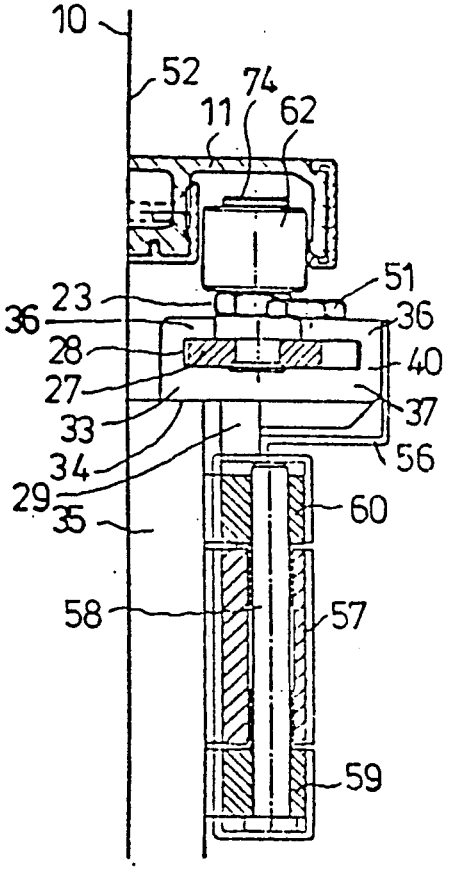
FIG. 6 shows a section along line VI—VI in FIG. 3 through the guide roller device.
Figure 8:
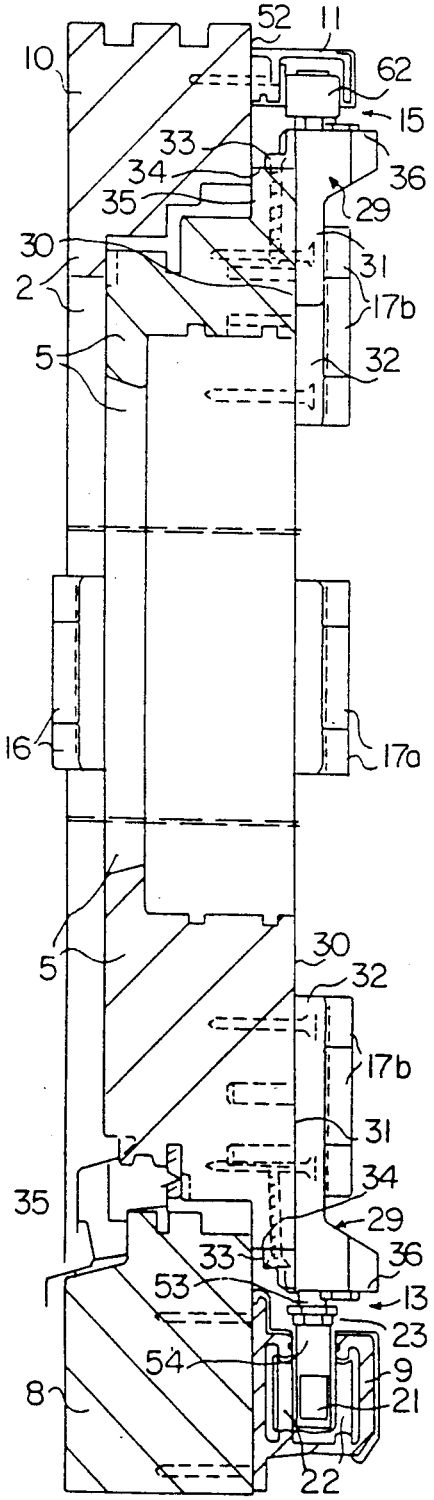
FIG. 8 shows in a larger scale a section along line VIII—VIII in FIG. 1.
Figure 9:
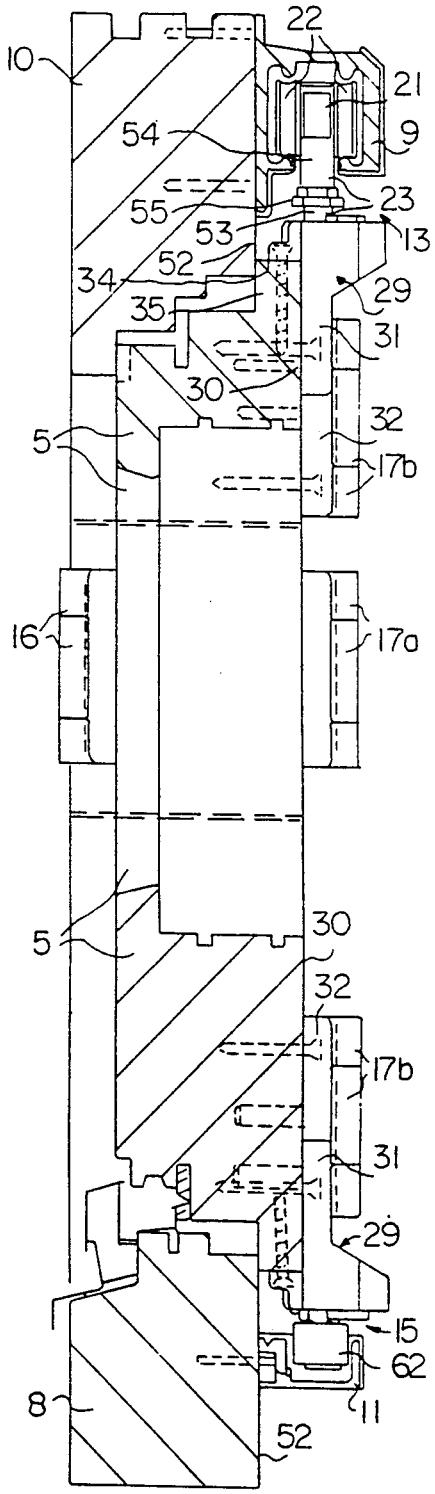
FIG. 9 shows a section corresponding to FIG. 8, but incorporating transposed support roller device and guide roller device.

The guide roller device associated with folding/sliding panel 5, as can be seen in FIGS. 3, 6, 8 and 9, and also in FIG. 7, basically has the same structure and the same mode of operation as the support roller device 13 of FIGS. 2, 4, 5 as well as 8 and 9. The only difference is that instead of rolling carriage 21 with the two pairs of support rollers 22, there is a single guide roller 62, whose support is arranged in axial alignment with axle bolt 23. The support of guide roller 62 thus consists of a sleeve 63, which may be combined with the headless threaded fastener 53 supported by bracket arm 26, for example, by screwing on, and can be secured in the attached position by a flange bolt 74, which, for example, may be pressed into a coaxial blind hole on the free end of headless threaded fastener 53. Since headless threaded fastener 53 for taking up sleeve 63 supporting guide roller 62 is completely identical with headless threaded fastener 53 which cooperates with thread sleeve 54 of running carriage 21, it is possible to mutually exchange guide roller 62 and rolling carriage 21 without problem. It is therefore possible with one and the same structured assembly to incorporate without problem the folding sliding panels in windows and doors both from right to left as well as from left to right in the stationary frame. Over and above this, the place of incorporation of support roller device 12 or 13 and guide roller device 14 or 15 may be exchanged mutually, as is illustrated in FIGS. 8 and 9.

According to FIG. 8, the folding/sliding panels 5 and 7 are supported on the support roller devices 12 or 13 arranged in a lower runner rail 9, whereas they are suspended on support roller devices 12 and 13 guided in a runner rail 9 attached in an upper position according to FIG. 9. Guide roller devices 14 and 15 work together with a guide rail 11 mounted on top according to FIG. 8, whereas they are engaged with a guide rail 11 mounted on the bottom according to FIG. 9.

Figure 10:
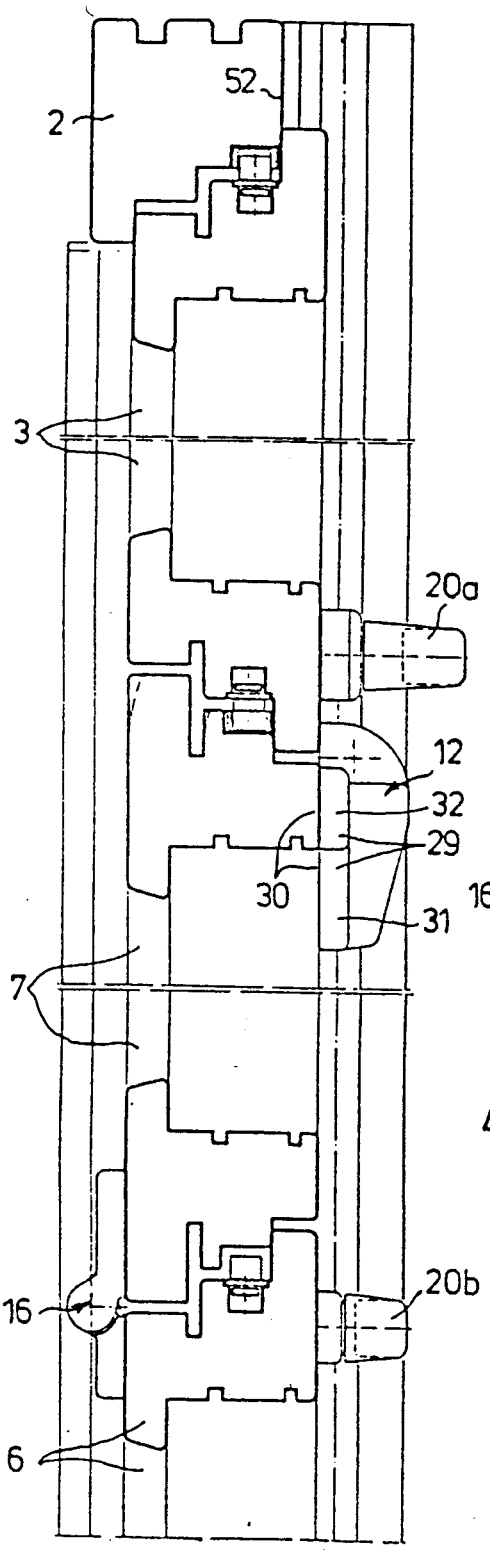
FIG. 10 shows on a larger scale a section along line X—X in FIG. 1.
Figure 11:
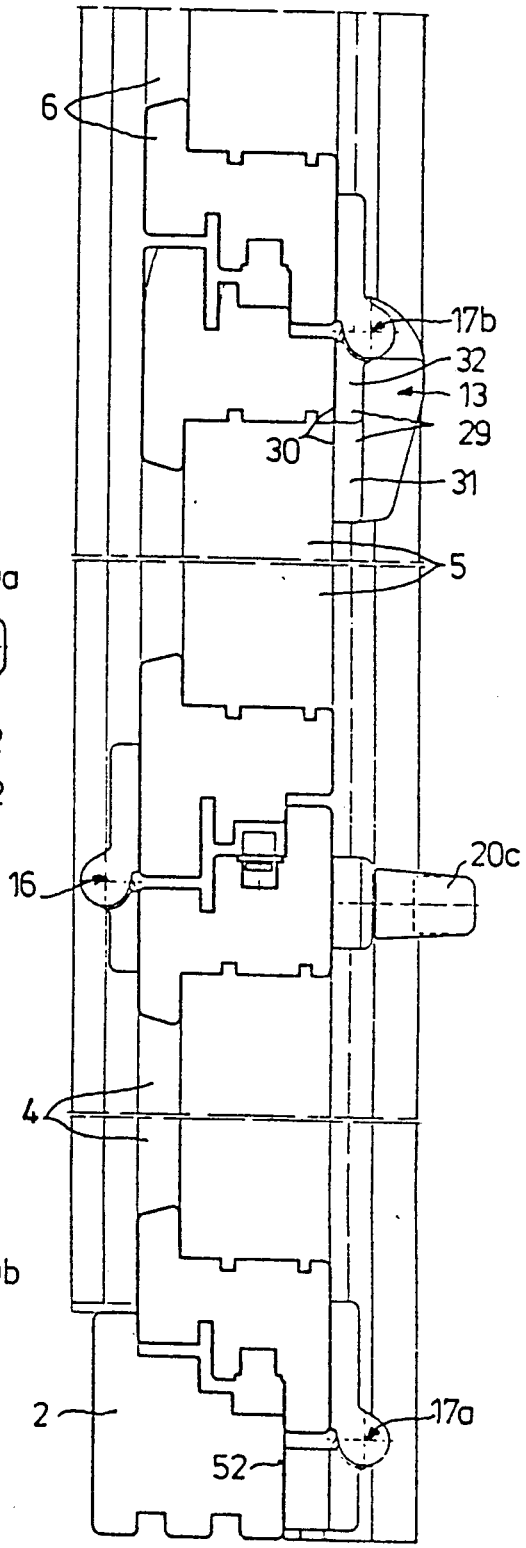
FIG. 11 shows on a larger scale a section along line XI—XI in FIG. 1.

FIGS. 10 and 11 of the drawing illustrate the alternate arrangement visible from FIG. 1 of outer hinges 16 and inner hinges 17*a* and 17*b* between the neighboring panels 4–7, by which panel 4 is supported by inner hinge 17*a* only as a turning panel on stationary frame 2, whereas panels 5–7 are joined together as a folding/sliding panel and folding/sliding panel 5 is articulated with turning panel 4.

FIG. 5 illustrates that it is also possible to adjustably attach hinge joint part 61 at a right angle to the longitudinal axis of socket pin 58 as well as parallel to front surface 30 of panels 4–7. For this purpose, a threaded socket 64 can be set up on front side 30 of the respective panel by means of a base plate or by a fixation pin 65 engaged in a borehole. A threaded coupling 66 engages in a rotatable manner in the threaded socket and can be axially displaced. An opening 67 in hinge joint part 61 is configured such that it encloses threaded socket 64 and threaded pin 66, whereby the end surfaces of threaded pin 66 are supported on cross-sectional edge surfaces 68 and 69 of opening 67. The compact head 70 of threaded pin 66 is provided with two engagements for tools (which are accessible to a socket wrench, for example,) by a hole 71 parallel to the axis of threaded pin 66. By an appropriate rotation of threaded pin 66, each hinge joint part 61 can be displaced with fine adjustment approximately parallel to runner rail 9 and to guide rail 11, in order to be able to change thereby the lateral distance between panels 4 and 5, 5 and 6, as well as 6 and 7 that are adjacent to each other.

Longitudinal holes 72 in hinge joint part 61 cooperate with threaded fastener 73 penetrating the latter and permit—after a slight loosening of threaded fasteners 73—the positional adjustment of hinge joint part 61 to the respective panel, e.g., to folding sliding panel 6. In addition, the hinge joint parts of outer hinges 16 and inner hinges 17*a* which correspond to hinge joint part 61 of support roller device 13 or guide roller device 15 may be provided with appropriate adjustment devices (comprising parts 64–73), if desired. Hinge joint parts 61 of support roller device 13 and guide roller device 15, for the formation of inner hinges 17*b*, and also the corresponding hinge joint parts of inner hinges 17*a* and outer hinges 16 may be used as adjustment devices, as the case may be.

In addition or alternately, cams engaged in longitudinal holes running crosswise to the adjustment direction can be utilized, as has been known for a long time, for example, according to FIGS. 1 and 2 of the drawing of German OS (Unexamined Patent Disclosure) 2,150,237. Threaded members used as adjustment devices also have the advantage, in contrast with a cam adjustment, that they can operate in a very sensitive manner and undergo a reliable self-locking in any adjustment position.

Clearly, minor changes could be made in the form and construction of this invention without departing from its material spirit. Therefore it is not desired to confine the the invention to the exact form shown herein and described but it is desired to include all subject matter that properly comes within the scope claimed.

The invention having been thus described, what is claimed as new and desired to secure by Letters Patent is:

1. Roller device for supporting and guiding a sliding panel of a closure, comprising:

(a) a running carriage for support and guide rollers in a stationary runner and guide rail, (b) a vertical axle bolt connected to the running carriage, around which a panel is moveable, (c) a support pedestal having a vertical portion and a horizontal portion, the vertical portion parallel to and fixed on a front side of the panel, the horizontal portion projecting out from said front side of the panel beyond the vertical portion and connected to the axle bolt by means of a bracket arm, (d) means of adjusting the vertical distance between the running carriage and the support pedestal, (e) a pocket formed in the horizontal portion of the support pedestal by two essentially horizontal support walls, (f) a plate having a larger portion held in the pocket in a limited and horizontally moveable manner and a relatively smaller portion extending from an opening in the pocket, and (g) means to fix the larger portion of the plate in a chosen horizontal position in the pocket, wherein said bracket arm connecting the horizontal portion of the support pedestal to the axle bolt comprises said smaller portion of said plate.

2. Roller device according to claim 1, further characterized by the fact that the length of the larger portion of the plate (27) in the pocket (28) corresponds to several times the distance between said vertical axle bolt (23) and the opening (41) into the pocket.

3. Roller device according to claim 1, further characterized by the fact that the plate (27) is held at the end of its larger portion in a limitedly angularly displaceable manner between two essentially vertical support walls (39, 40) of the pocket (28), and that these support walls (39 and 40) at the opening (41) into the pocket (28) have a distance between them which corresponds to a chosen adjustment path in excess of the width at the pocket of said larger portion of the plate (27).

4. Roller device according to claim 1, further characterized by the fact that plate (27) is fixed in the pocket (28) by clamping elements (43, 47, 51).

5. Roller device according to claim 4, further characterized by the fact that the clamping elements are formed by a threaded fastener (43) with head passing through a hole (44) in plate (27) and through bow slots (45, 46) in the horizontal support walls (37, 38) of pocket (28) and by a nut (51) engaged by the latter.

6. Roller device according to claim 5, further characterized by the fact that the threaded fastener (43) has a head and engages retaining surfaces (50) with the head (47) between stationary pieces (48, 49) of the support pedestal (29) to prevent the threaded fastener from rotating.

7. Roller device according to claim 1, further characterized by the fact that the axle bolt consists of a headless threaded fastener (53) joined in a rotation-proof manner with the bracket arm (26) and a threaded sleeve (54) holding the running carriage (21) of the support and guide roller (62), wherein the threaded sleeve (54) is provided with means to be axially displaced and means to be made fast by a lock nut (55).

8. Roller device according to claim 1, in which the support pedestal (29) has an angled form, having an upright angled portion and a horizontal angled portion, further characterized by the fact that the pocket (28) is integrally formed in the horizontal angled portion (31) of the support pedestal (29).

9. Roller device according to claim 1, further characterized by the fact that a hinge sleeve (57) with a vertical axis is joined with an outer limiting edge of the upright angled portion (32) of the support pedestal (29).

10. Roller device according to claim 9, further comprising complementary hinge sleeves (59, 60) of a hinge plate of a hinge joint part (61) for an adjacent panel (6) are provided and are adapted to be coupled in a detachable manner with said hinge sleeve on the support pedestal (57) by means of a socket pin (58).

11. Roller device according to claim 10, further characterized by the fact that the hinge plate of hinge joint part (61) of the adjacent panel is held in an adjustable manner on a said adjacent panel (6) crosswise to the hinge axis, but parallel to the panel plane by means of adjustment means chosen from: threaded components or cams.

* * * * *